United States Patent [19]

McCormick

[11] Patent Number: 4,893,448

[45] Date of Patent: Jan. 16, 1990

[54] STEEL EXPANSION JOINT

[76] Inventor: Wilbert McCormick, 2039 Swanson Ave., Suite 2E, Lake Havasu City, Ariz. 86403

[21] Appl. No.: 313,856

[22] Filed: Feb. 23, 1989

[51] Int. Cl.[4] ..... E01C 11/12; E01C 11/04

[52] U.S. Cl. ..... 52/396; 52/395; 404/47; 404/55; 404/68

[58] Field of Search ..... 52/393, 395, 396, 403; 404/47–68, 76

[56] References Cited

U.S. PATENT DOCUMENTS

| | | | |
|---|---|---|---|
| 2,038,605 | 4/1936 | Robertson | 404/55 |
| 2,286,019 | 6/1942 | Smith | 404/47 |
| 3,344,720 | 10/1967 | Hallock | 404/47 |
| 3,390,501 | 7/1968 | Driggers | 52/395 |
| 4,504,170 | 3/1985 | Scaukolinski | 52/396 X |
| 4,774,795 | 10/1988 | Braun | 52/396 |

FOREIGN PATENT DOCUMENTS

| | | | |
|---|---|---|---|
| 1409836 | 10/1968 | Fed. Rep. of Germany | 404/68 |

*Primary Examiner*—Richard E. Chilcot, Jr.
*Attorney, Agent, or Firm*—Terry M. Gernstein

[57] ABSTRACT

A covering for an expansion joint is formed of a plurality of monolithic steel elements that are arranged to be self-cleaning and so as not to be subject to binding. The joint has an overall T-shape and is bilaterally symmetric. The joint includes two L-shaped portions each attached to a structural element for movement therewith. The joint cover has a steel plate on one leg of each L-shaped portion bordering the expansion gap. A spacer plate is also fixed to the leg of the L-shaped portion and forms a sealant-receiving channel with the leg and the plate. An expansion gap spanner plate slidably rests on top of the plate and a cover plate is fixed at one end to the spacer plate and slidingly engages the spanner plate to keep it in the desired position and orientation during movement of the joint.

10 Claims, 5 Drawing Sheets

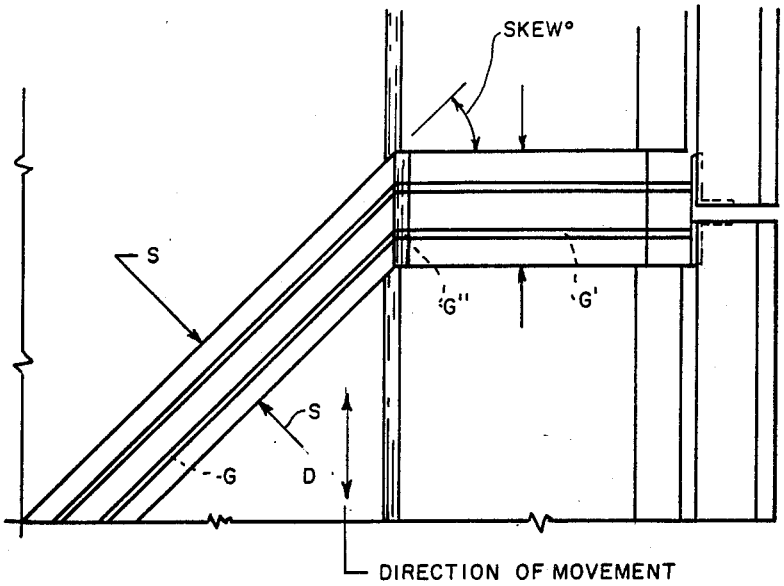
FIG. 6
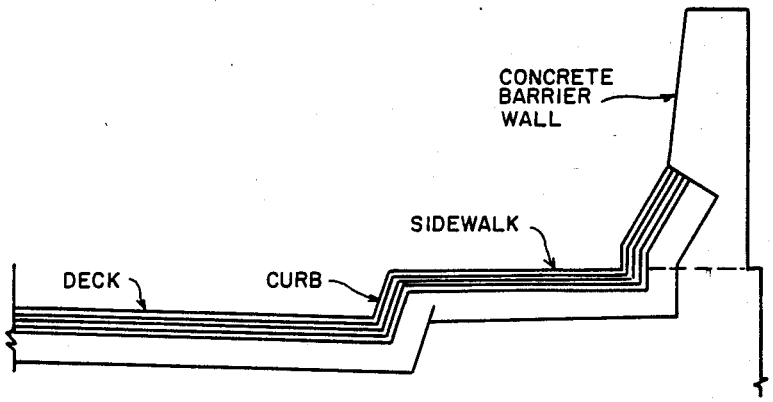
FIG. 5
| GAP DIM. mm | | | INSTALLATION TEMPERATURE | | | | | |
|---|---|---|---|---|---|---|---|---|
| | MIN | MAX | 5°C | 10°C | 15°C | 20°C | 25°C | 30°C |
| | | | | | | | | |
FIG. 9

STEEL EXPANSION JOINT

TECHNICAL FIELD OF THE INVENTION

The present invention relates to the general field of expansion joints, and to the particular art of expansion joint structures used to prevent water, debris or the like from entering the expansion joint.

BACKGROUND OF THE INVENTION

The need for expansion joint structures between segments of bridge decking and between bridge decking and adjacent structures, as well as between adjacent sections of a structural body, such as a building, a roadway, or the like, are well known and have long been recognized. Accordingly, there have been many proposals for such structures.

All of the expansion joint structures are subject to several constraints. For example, such structures are subject to vehicular traffic, and thus must be sufficiently strong to withstand the loading associated with such traffic. Further, the joint structure must be designed to provide a smooth and quite ride thereover without skidding, and must be able to resist snow plow loading without moving. Still further, such joint structures are often subject to the corrosive action of sale and other snow-control materials, yet the structure must be easily accessible for inspection, maintenance, replacement and modification. Still further, such expansion joint structures should be easily and inexpensively stored, transported, and installed in a wide variety of applications.

These various requirements have led to several different design proposals. For example, some designs have included interdigitating metal fingers or overlapping metal tongues. While somewhat successful, such metal expansion joint structures are unduly subject to attack by the corrosive salts and other snow control materials thereby creating maintenance, binding and other failure-producing problems, especially in climates having a great deal of snow fall.

Even protecting such metal joints by placing a protective mat thereover has not been entirely successful.

Therefore, further designs have been proposed which have included non-metal joint structures. Elastomeric materials have been used as the primary non-metal material.

However, such joint structures have not been entirely successful either since non-metal structures have a tendency to become brittle, and are not as resistant to wear and tear as are the metal structures, thereby increasing the maintenance costs associated therewith. In particular, such non-metal joint structure are susceptible to being damaged by snow plows.

Accordingly, there is a need for an expansion joint structure that is as reliable as metal, yet is designed in a manner that overcomes the above-mentioned problems that have been associated with heretofore proposed metal joint structures.

OBJECTS OF THE INVENTION

It is a main object of the present invention to provide a metal expansion joint structure that is not susceptible to malfunctioning due to corrosion or other such causes.

It is another object of the present invention to provide an all-metal expansion joint that can be custom designed according to the expected size of the expansion gap.

It is another object of the present invention to provide an all-metal expansion joint structure that is capable of accommodating large expansion gaps. Gaps in excess of 100 mm generally require modular expansion joints. It is an object of the present invention to accommodate such large expansion gaps.

It is another object of the present invention to provide a metal expansion joint structure that accommodates both translational and rotational movements.

It is another object of the present invention to provide a metal expansion joint structure that provides a smooth ride for vehicular traffic.

It is another object of the present invention to provide a metal expansion joint structure that is not susceptible to damage by snow plows.

It is another object of the present invention to provide a metal expansion joint structure that is easily accessible for maintenance, replacement and modification.

It is another object of the present invention to provide a metal expansion joint structure that is self-cleaning.

It is another object of the present invention to provide a metal expansion joint structure that is capable of being associated with expansion joints that are in various planes.

It is another object of the present invention to provide a closed all-metal expansion joint that works properly in skew.

It is another object of the present invention to provide a metal expansion joint structure that is capable of being associated with an expansion joint that has the structures associated with the expansion joint moving at an angle with respect to the expansion joint.

It is another object of the present invention to provide a closed metal expansion joint that is not susceptible to damage from corrosive salts or the like that are used on roads for snow and ice removal.

SUMMARY OF THE INVENTION

These, and other, objects are accomplished by a metal expansion joint structure that includes a plurality of monolithic elements with an expansion joint gap cover that is held in place by a cover plate and is adapted to move into a channel in a manner that produces a self-cleaning capability for the joint structure.

The gap cover element rides on top of a plate that is mounted on an L-shaped portion. A spacer portion also is mounted on the L-shaped portion and defines the aforementioned channel with the plate portion. The L-shaped portions move with the structural elements forming the gap with respect to the gap cover and that cover keeps debris and the like from falling into the gap while the movement of the various portions of the joint structure with respect to each other provides a cleaning action. Lubricating means can be placed into the channel to assist movement and sealing of the joint structure.

The preferred embodiment of the joint structure is T-shaped, but other shapes can be used, as will be disclosed herein.

DESCRIPTION OF THE FIGURES

FIG. 5 is an elevational view of a deck/sidewalk combination which includes the expansion gap joint covering structure of the present invention.

FIG. 6 is a plan view of the FIG. 5 embodiment.

FIG. 9 is a table used to determine installation requirements for the structure embodying the present invention.

DETAILED DESCRIPTION OF THE PREFERRED EMBODIMENT OF THE INVENTION

Figure 1:
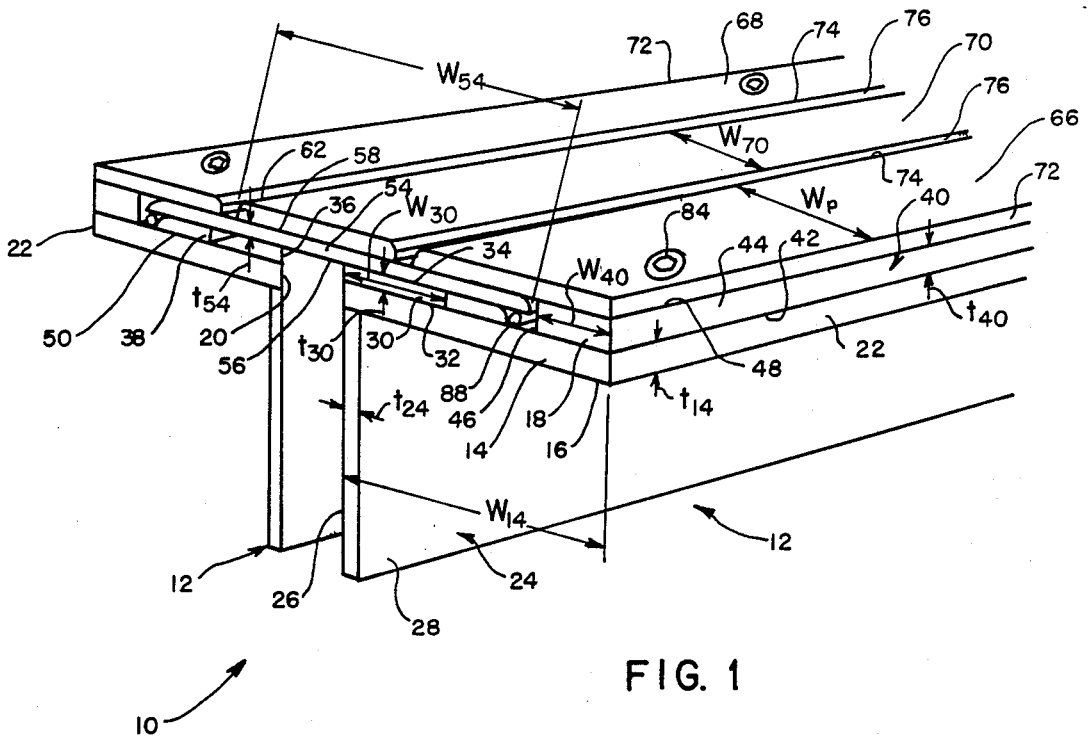
FIG. 1 is a perspective view of the expansion gap covering joint structure embodying the present invention.
Figure 2:
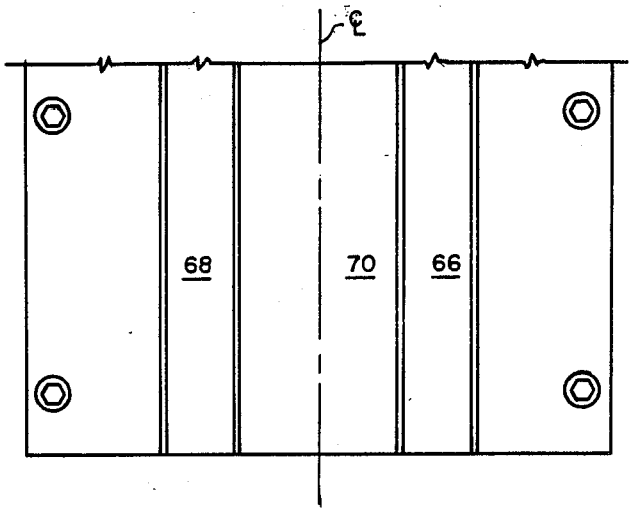
FIG. 2 is a plan view of the expansion gap covering joint structure of the present invention.
Figure 3:
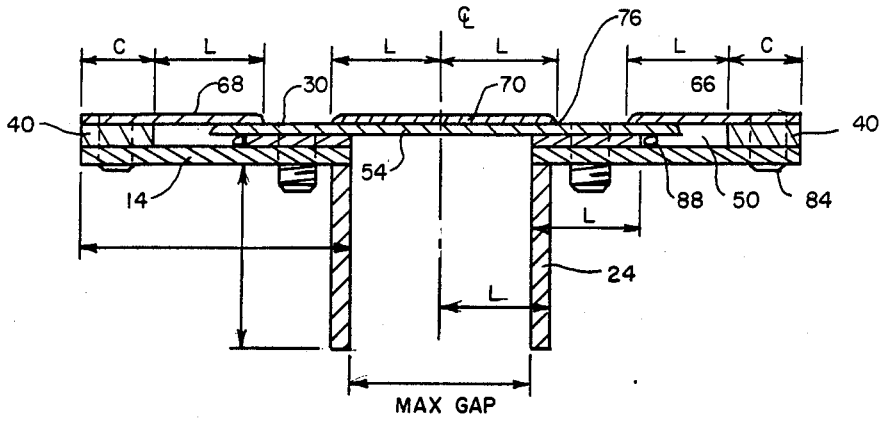
FIG. 3 is an elevational view showing the expansion gap joint covering structure in its widest configuration.

Shown in FIGS. 1 through 3 is a metal expansion joint structure 10 that is suitable for covering the expansion joint defined between two sections of a roadway, a bridge, a building or the like. Such expansion joints are commonly used to accommodate thermal expansion and contraction associated with such structures. Since there is a gap that must be maintained, any debris, water or the like entering the gap will be detrimental to the operation of the gap. Accordingly, the all-metal structure 10 is intended to protect such gap while overcoming the abovementioned problems usually associated with metal expansion gap covering joint structures while resisting corrosion from salts and other snow-control materials and while also resisting attrition from highway traffic, snow plow blades and from punctures caused by captured debris.

The structure 10 is bilaterally symmetric and thus like elements on both sides of the longitudinal centerline CL will be given similar reference numerals.

The structure 10 includes two monolithic steel L-shaped portions 12 each of which includes a first leg 14 adapted to be affixed to the structural element which forms the expansion gap for movement therewith. Each first leg 14 includes a bottom surface 16 that is in abutting contact with the structural element, and a top surface 18 that faces away from that structural element. The first leg thus has a thickness $t_{14}$ defined between the bottom surface 16 and the top surface 18. The leg 14 further includes a first edge 20 located adjacent to the gap and a second edge 22 located spaced from the gap to define a leg width $w_{14}$ between the first and second edges of the leg 14.

The leg 14 can have an undefined length.

The L-shaped portion 12 further includes a second leg 24 having a front surface 26 adapted to face into the expansion gap and a rear face 28 adapted to lie in abutting contact with the structural element. The second leg has a thickness $t_{24}$ that is defined by the distance between the front and rear surfaces 26 and 28 respectively, and has a length corresponding to that of the first leg 14.

The expansion joint structure 10 further includes two monolithic steel plate portions 30. Each of the plate portions 30 is elongated and has a bottom surface 32 fixed to the top surface 18 of an associated first leg 14 to move therewith. Each of the plate portions 30 includes a top surface 34 spaced from the bottom surface 32 to define a thickness $t_{30}$ for each of the plate portions. As before, the length of the plate portions corresponds so the length of the expansion joint gap. The plates have edges that include a first edge 36 located adjacent to the expansion gap and a second edge 38 spaced therefrom to define a width $w_{30}$ for each plate portion 30 that is less than $w_{14}$. As shown, the edges 38 can be beveled.

The structure 10 further includes two spacer plates 40 each being associated with one of the L-shaped portions 12. Each spacer plate 40 includes a bottom surface 42 fixedly attached to the top surface 18 of the first leg 14 at a location that positions first edge 44 of the spacer plate 40 adjacent to the second edge 22 of the leg 14. Each spacer plate further includes a second edge 46 spaced from the first edge 42 to define a width $w_{40}$ for the spacer plate that is less than width $w_{14}$ of the leg 14. Each spacer plate 40 further includes a top surface 48 that faces away from the bottom surface and defines with such bottom surface a thickness $t_{40}$ for the spacer plate 40.

The spacer plate second edge 46 is spaced from the second edge 38 of the plate portion 30 to define a channel 50 with the top surface 18 of the first leg 14. The channel 50 will be discussed in further detail below.

The structure 10 further includes one monolithic steel expansion gap spanner plate 54 that includes a bottom surface 56 facing inwardly of the expansion gap and a top surface 58 facing outwardly of the expansion gap. The spanner plate 54 has a thickness $t_{54}$ defined by the top and bottom surfaces 58 and 56 respectively. The spanner plate includes a first edge 60 located on one side of the longitudinal centerline and a second edge 62 located on the other side of the longitudinal centerline CL to define a width $w_{54}$ for the spanner plate 54. The spanner plate 54 overlies the expansion gap.

The structure 10 further includes three cover plates 66, 68 and 70, with plates 66 and 68 being located adjacent to each second edge 22 of each first leg 14, with the other plate 70 overlying the longitudinal centerline. Plates 66 and 68 are identical, and each includes a first edge 72 located adjacent to the second edge 22 and a second edge 74 located closer to the longitudinal centerline CL than the first edge 72. The plate 70 has longitudinal edges 76 located adjacent to, but spaced from, the second edge 74 of each of the plates 66 and 68. The second edges of the plates 66 and 68 and both edges of the plate 70 are beveled, and the edges 76 of the plated 70 are spaced apart to define a width $w_{70}$ for the plate 70. Each of the plates 66 and 68 also has a width $w_p$ as defined between the edges 72 and 74.

Each of the plates 66 and 68 has a width $w_p$ that is As can be seen from FIG. 3, the width $w_54$ must be at least equal to the maximum width $w_{max}$ for the expansion gap plus $2(t_{24})$. As indicated in FIG. 3 the width $w_{70}$ is equal to 2L, with $L=(\frac{1}{2})(w_{max})$.

The width of the plates 66 and 68 can be equal to L+C, where C=a number associated with the particular expansion gap, such a 50 mm, or the like, FIG. 9 shows a table that can be used to determine the various dimensions of the structure 10 under various temperature conditions. The structure 10 is therefore quite versatile in design as the width of the overall device is determined by the anticipated amount of movement of the expansion gap. Moreover, this design will serve for large gaps, e.g., over 100 mm and up to 300 mm, where costly modular-type joints are presently used.

A sealant can be located in the closed channel 50 or a seal ring, such as seal ring 88, or the like, can be located in the channel 50. The seal ring can be a monolithic steel rod, such as 6 mm 200 steel, or the like. This rod is shown as being circular, but could be polygonally shaped, such as square, if desired to prevent fleck gathering or the like. The steel rod will not be susceptible to becoming brittle and cannot be punctured thereby adding reliability to the structure 10. Furthermore, a grease gun and appropriate fittings can be included if so desired. The channel 50 is shown as being polygonal, but other shapes, such as circular, can be used if necessary.

Other embodiments of the structure 10 can be used to cover an expansion gap in a combination of structures, such as a selected so that each of the plates 66 and 68 will always overly the spanner plate and will close the channel 50 associated therewith as shown in FIG. 1 for all configurations of the structure 10. Each of the plates 66 and 68 is fixedly attached to the spacer plates 40 to move with the associated first leg 14. However, the plates 66 and 68 are slidingly mounted on the spanner plate 54 so that the movement of the arms 14 toward and away from each other will not be inhibited by the non-moving nature of the spanner plate 54. The cover plates extend over the channels 50 to close such channels.

The thicknesses of the elements 30, 40 and 54 are adjusted to effect a secure mounting of the cover plates yet permit a secure sliding mount of the cover plates on the spanner plate. Thus, the thickness $t_{40}$ is essentially equal to $(t_{54} + t_{30})$ so that top surfaces 48 and 58 are essentially co-planar.

Fastener elements, such as screw fasteners 80, can be used to secure the spanner plate 54, the plate portion 34 and the first leg 14 together and to the structural section forming the expansion gap. Further fastening elements, such as fasteners 84, can be used to secure the cover plates 66 and 68 to the spacer plates 40, and the cover plate 70 can be welded or otherwise securely affixed to the spanner plate 54. The cover plates 66, 68 and 70 can have a skid-preventing covering on the top surfaces thereof if so desired.

Figure 4:
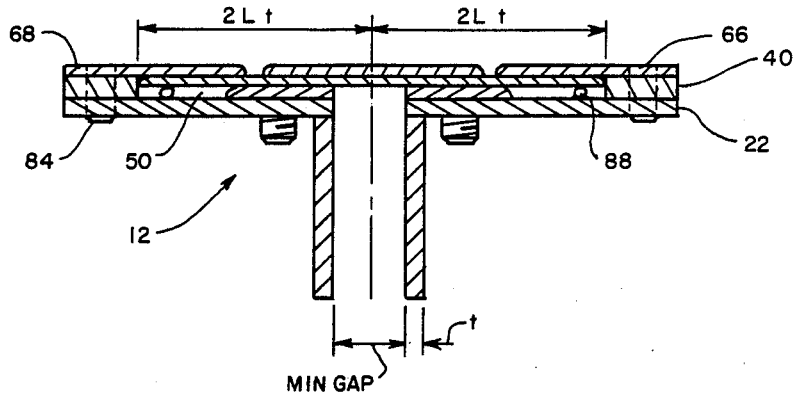
FIG. 4 is an elevational view showing the expansion gap joint covering structure in its narrowest configuration.
Figure 7:
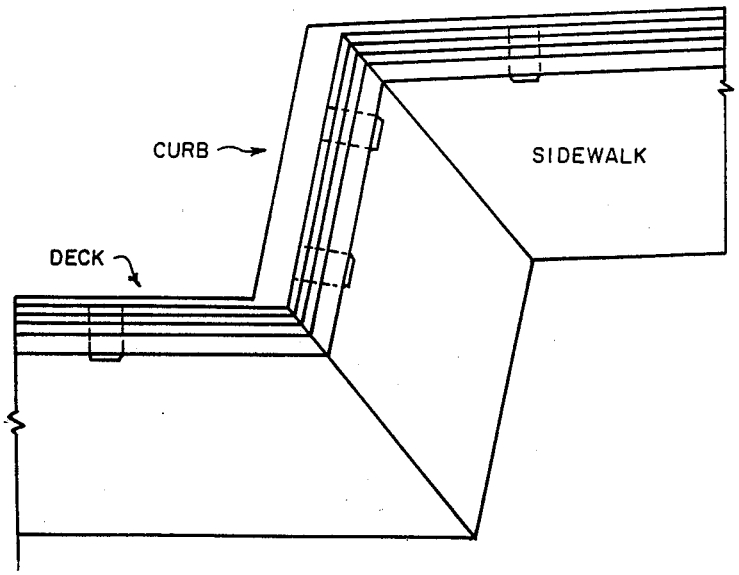
FIG. 7 is an elevational view of a curb portion of the FIG. 5 embodiment.
Figure 8:
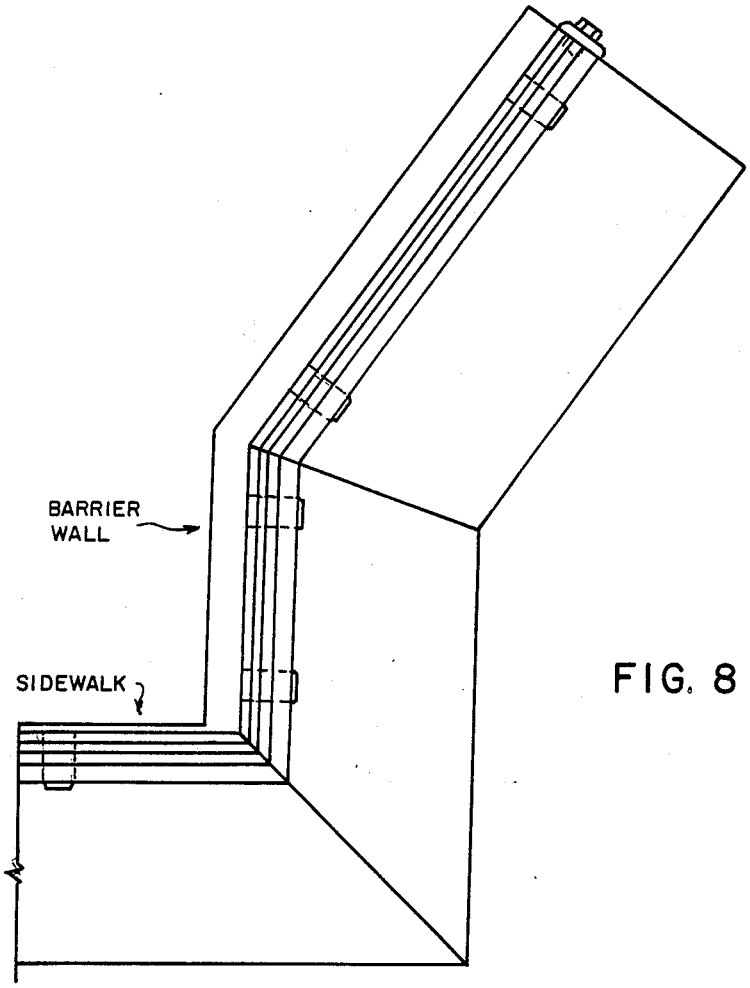
FIG. 8 is an elevational view of the barrier wall portion of the FIG. 5 embodiment.

The orientation of the elements of the structure 10 is shown in FIG. 3 for the maximum expansion gap width condition, and in FIG. 4 for the minimum expansion gap width condition. gap G in FIG. 6 that is skewed with respect to the direction of movement of the structures as indicated by the arrow D in FIG. 6, and which can be used to cover a gap G′ that is in a different plane from the gap G and is at an angle with respect thereto. The skew is indicated in FIG. 6 arrows S. For example, the gaps G and G′ can be associated with a deck, curb and sidewalk combination, with a gap G″ being located in the curb at an angle with respect to both of the gaps G and G′ and in a plane that is different from the planes containing such gaps G and G′. It is noted that in the skewed configuration, the steel plates interact diagonally with each other so there is no undue stresses developed in the structure. Thus, the closed joint structure 10 will work correctly in the skewed condition.

Other than the orientation of the elements, the expansion gap joint cover structures shown in association with the gaps G, G′ and G″ are similar to that shown and discussed above.

In the preferred embodiment, the steel is CAS Standard G40 21 M Grade 300 W or equal, with the fastening bolts conforming to ASTM 325. Any welding should be of a low hydrogen classification, and manual electrodes should be E7016 or E7018. All welding should be in accordance with CSA W59. The sealant should be a standard oil calumet No. 10 , or an acceptable viscose grease, and the joint structure should be fabricated to suite the skew of the bridge or other such structure. Shop assembly can be used if desired.

It is to be understood that while certain forms of the present invention have been illustrated and described herein, it is not to be limited to the specific forms or arrangement of parts described and shown.

I claim:

1. An expansion joint structure for use in conjunction with a variable width expansion gap between two structural sections of a roadway, a bridge, a building or the like, which are subject to expansion and contraction due to temperature changes and the like, comprising:

(A) two monolithic steel L-shaped expansion joint structure portions, each being fixedly attached to an associated structural section of two structural sections which are spaced apart to define an expansion gap, each including (1) a first leg having a bottom face in abutting contact with said associated structural section, a top face , a thickness dimension as defined between said first leg bottom face and said first leg top face, a first edge located adjacent to said expansion gap, a second edge located to be spaced from said expansion gap, and a width dimension as defined between said first leg first and second edges, (2) a second leg having one edge attached to said first leg adjacent to said first leg first edge and extending into said expansion gap, said second leg including a rear surface in abutting contact with said associated structural section and a front surface facing into said expansion gap;

(B) two monolithic steel plate portions each including (1) a first surface in abutting contact with an associated L-shaped portion first leg top surface, a top surface, a thickness dimension as measured between said plate portion top surface and said plate portion bottom surface, a first edge located adjacent to said L-shaped portion first leg first edge, a second edge located to be spaced from said plate first edge, and a width dimension as measured between said plate portion first edge and said plate portion second edge, (2) fastening means fixedly attaching said each plate portion to said associated L-shaped portion first leg;

(C) two monolithic steel spacer plates each including (1) a bottom surface in abutting contact with an associated one of said L-shaped plate portion first legs, a top surface, a thickness dimension as measured between said each spacer plate top surface and said each spacer plate bottom surface, a first edge located adjacent to said L-shaped portion first leg second edge, a second edge spaced from said each spacer plate first edge, a width dimension as measured between said each spacer plate first edge and said each spacer plate second edge, (2) said each spacer plate second edge being spaced from a second edge of an adjacent plate portion to define a channel;

(D) a monolithic steel expansion gap spanner plate having a bottom surface slidably resting on said spacer plate top surfaces, a top surface and a thickness dimension as measured between said spanner plate top surface and said spanner plate bottom surface;

(E) said each spacer plate thickness being essentially equal to the combined thicknesses of said each plate portion and said expansion gap spanner plate whereby said expansion gap spanner plate top surface and said spacer plate top surfaces are essentially co-planar; and (F) two monolithic steel cover plates, each including a bottom surface fixedly attached to a top surface of a spacer plate associated therewith and slidably resting on the top surface of said gap spanner plate adjacent to one edge of said expansion gap spanner plate, each of said cover plates extending over an associated channel of said channels to close both of said channels and engaging said expansion gap spanner plate to control movement of said expansion gap spanner plate.

2. The expansion joint structure defined in claim 1 further including a third monolithic steel cover plate fixedly mounted on said expansion gap spanner plate top surface.

3. The expansion joint structure defined in claim 2 further including a sealing ring located in said channel.

4. The expansion joint structure defined in claim 3 wherein said fastening means includes a plurality of threaded fasteners.

5. The expansion joint structure defined in claim 4 wherein said expansion gap is oriented at an angle with respect to the movement of said structure sections.

6. The expansion joint structure defined in claim 5 further including a second expansion gap which is oriented transverse to the movement of said structure sections and which is located adjacent to said angled expansion gap, and a further expansion joint structure as defined in claim 1.

7. The expansion joint structure defined in claim 6 wherein said second expansion gap is in a plane different from said first expansion gap.

8. The expansion joint structure defined in claim 7 further including a third expansion gap in a plane different from said first and said second expansion gaps, and an expansion joint structure associated therewith having the elements defined in claim 1.

9. The expansion joint structure defined in claim 4 wherein said expansion gap has a width as measured between said two structure sections and said expansion gap spanner plate has a width which is essentially equal to the maximum expansion gap plus the combined thickness of said L-shaped portion second legs.

10. The expansion joint structure defined in claim 9 wherein said cover plates include beveled edges.

* * * * *